US006753821B2

(12) United States Patent
Yang et al.

(10) Patent No.: US 6,753,821 B2
(45) Date of Patent: Jun. 22, 2004

(54) METHOD AND ARRANGEMENT OF ANTENNA SYSTEM OF EAS

(75) Inventors: Xiaohui Yang, Cupertino, CA (US); Arthur Fuss, Studio City, CA (US)

(73) Assignee: WG Security Products, Inc., San Jose, CA (US)

( * ) Notice: Subject to any disclaimer, the term of this patent is extended or adjusted under 35 U.S.C. 154(b) by 71 days.

(21) Appl. No.: 10/235,225

(22) Filed: Sep. 4, 2002

(65) Prior Publication Data

US 2003/0197652 A1 Oct. 23, 2003

Related U.S. Application Data

(60) Provisional application No. 60/374,920, filed on Apr. 22, 2002, provisional application No. 60/376,236, filed on Apr. 26, 2002, provisional application No. 60/374,920, filed on Apr. 22, 2002, and provisional application No. 60/376,236, filed on Apr. 26, 2002.

(51) Int. Cl.[7] ..... H01Q 11/12

(52) U.S. Cl. ..... 343/742; 343/867; 340/572.7

(58) Field of Search ..... 343/741, 742, 343/866, 867; 340/572.7, 505; 455/127

(56) References Cited

U.S. PATENT DOCUMENTS

| | | | | |
|---|---|---|---|---|
| 4,215,342 A | | 7/1980 | Horowitz | 340/572 |
| 4,260,990 A | * | 4/1981 | Lichtblau | 343/742 |
| 5,005,001 A | | 4/1991 | Cordery | 340/551 |
| 5,103,234 A | * | 4/1992 | Watkins et al. | 343/742 |
| 5,103,235 A | * | 4/1992 | Clemens | 343/742 |
| 5,239,696 A | | 8/1993 | Balch et al. | 455/127 |
| 5,463,376 A | | 10/1995 | Stoffer | 340/572 |
| 5,512,878 A | | 4/1996 | Balch et al. | 340/572 |
| 5,640,693 A | | 6/1997 | Balch et al. | 455/127 |
| 5,673,024 A | | 9/1997 | Frederick et al. | 340/572 |
| 5,699,045 A | | 12/1997 | Frederick et al. | 340/551 |
| 5,793,289 A | | 8/1998 | Strzelec | 340/572 |
| 5,894,270 A | | 4/1999 | Clancy et al. | 340/572.4 |
| 5,909,178 A | | 6/1999 | Balch et al. | 340/572.4 |
| 5,914,692 A | | 6/1999 | Bowers et al. | 343/742 |
| 5,963,173 A | | 10/1999 | Lian et al. | 343/742 |
| 6,118,378 A | | 9/2000 | Balch et al. | 340/572.7 |
| 6,169,483 B1 | | 1/2001 | Ghaffari et al. | 340/572.3 |
| 6,351,216 B1 | | 2/2002 | Frederick et al. | 340/572.4 |

* cited by examiner

*Primary Examiner*—Tan Ho
(74) *Attorney, Agent, or Firm*—Haverstock & Owens LLP

(57) ABSTRACT

An antenna system for an electronic article surveillance system, comprising: a first antenna and a second antenna, the first antenna and the second antenna mounted for use in a substantially overlapping manner, the first antenna configured as a loop, the second antenna configured in a "figure-8"; a control circuit for selectively activating one of the first and second antennas. The first and second antennas each operate as a transmit and receive antenna. The control circuit further comprises a switch to selectively enable operation of one of the antennas when the other is open circuit. One of the antennas transmits and receives while the other is open circuit, and vice versa. The loop antenna substantially detects markers oriented substantially perpendicular to an elongated axis when entering into a surveillance area. The "figure-8" antenna substantially detects markers oriented substantially parallel to an elongated axis when entering into a surveillance area.

45 Claims, 3 Drawing Sheets

METHOD AND ARRANGEMENT OF ANTENNA SYSTEM OF EAS

RELATED APPLICATIONS

This application claims priority under 35 U.S.C. § 119(e) of the co-pending U.S. Provisional Patent Applications Serial No. 60/374,920 filed Apr. 22, 2002 and entitled "METHOD AND ARRANGEMENT OF ANTENNA SYSTEM OF EAS" and Serial No. 60/376,236 filed Apr. 26, 2002 and entitled "METHOD AND ARRANGEMENT OF ANTENNA SYSTEM OF EAS." The Provisional Patent Applications Serial No. 60/374,920 filed Apr. 22, 2002 and entitled "METHOD AND ARRANGEMENT OF ANTENNA SYSTEM OF EAS" and Serial No. 60/376,236 filed Apr. 26, 2002 and entitled "METHOD AND ARRANGEMENT OF ANTENNA SYSTEM OF EAS" are also hereby incorporated by reference.

FIELD OF THE INVENTION

The present invention relates to the field of electronic article surveillance (EAS) systems, and in particular, to EAS antenna systems for both transmitting and receiving signals in all directions.

BACKGROUND OF THE INVENTION

Antenna systems usually comprise two units positioned either side of a store doorway or at a checkpoint aisle, and are often referred to as gates, pedestals, panels, or detectors. In many systems, one antenna fulfills the role of transmitter, with the other acting as receiver. Single antenna systems may also be offered which combine transmitter and receiver functions into a single transceiver unit. This may be advantageous where space is limited.

Antennas at the doorway are coupled to a control system. In response to the control system, the antenna emits an energy field or frequency signal into a surveillance area. An anti-theft tag or marker that enters the antennas' surveillance area responds to this energy field by emitting its own frequency signal. When the antennas pick up this return frequency, an audible alarm is triggered on the antennas.

The arrangement and operation of an antenna system contributes to ensuring reliable and efficient performance of an electronic article surveillance (EAS) system. Antenna systems used in EAS sometimes do not detect markers. As an example, certain positions and orientations of a marker in a surveillance area can be optimal, whereas other positions and orientations can be inferior. Likewise, it is possible for a marker to be positioned in an orientation wherein it is sufficiently excited by an antenna and not be simultaneously in an orientation that the marker can be optimally detected or received by the antenna.

In the case of systems like the Ultra-Max® of Sensormatic Electronics Corporation, a first rectangular upper antenna loop and a rectangular second lower antenna loop are positioned in an in-phase mode to transmit signals into a surveillance area. A set of receiver antennas are positioned to operate, which also consists of one upper antenna and one lower antenna, receives signals from the surveillance area.

A disadvantage of this arrangement is the strength generated by the magnetic field in the vertical direction and middle position can be inadequate for reliable detection of a marker in the surveillance area. This is theorized to be due to rectangular loop or in-phase mode antenna configuration of the Ultra-Max® system, which provides substantial horizontal magnetic field, but a substantially weaker vertical magnetic field.

An improved prior art is Sensormatic's Ultra-Post system as disclosed in U.S. Pat. No. 5,963,173, wherein a first upper antenna and a second lower antenna work in interlaced modes, or in-phase transmission mode and out-of-phase transmission mode. Out-of-phase mode simply means the loops are driven by current flowing in opposite directions. The system generates substantial magnetic field in a vertical direction, but little or no strength in a horizontal direction. A receiver adds up the signals detected from both a first upper receiving antenna and a second lower receiving antenna. Signals received by the two receiving antennas may be added together to form a composite signal depending on whether signals are 90 degrees out of phase or 180 degrees out of phase.

The inter-laced mode of operation transmits signals in both horizontal and vertical directions. The in-phase mode provides significant coverage in a horizontal direction while the out-of-phase mode provides significant coverage in a vertical direction. The two modes of operation compliment each other.

With the Ultra-Post system, the different transmission modes make it difficult to tune antenna sets for accurate resonant frequency. Therefore, some additional compensation circuit is used to compensate for this design. Secondly, transmitting antennas and receiving antennas are separately dealt with in the Ultra-Post system instead of being treated as a whole system to optimize overall system performance.

What is needed is an improved system and method wherein a transmitting and receiving antenna are arranged as an integrated system to provide better magnetic field coverage in all directions without requiring multi-source signals, which are different in phase.

SUMMARY OF THE INVENTION

An antenna system for an electronic surveillance system, in accordance with an inventive arrangement, comprises a first antenna and a second antenna, the first antenna and the second antenna mounted for use in a substantially overlapping manner, the first antenna configured as a loop, the second antenna configured in a "figure-8"; and, a control circuit for alternatively activating the first and second antennas.

The first and second antennas can each operate one at a time as a transmit and receive antenna. The first antenna and second antenna substantially lie in a common plane. Thus, by alternatively toggling between operation of the first antenna and the second antenna all markers in the surveillance area can be detected regardless of position and orientation. Furthermore, the system is configured that the first antenna transmits and then receives while the second antenna is open circuit. Alternatively, the second antenna transmits and then receives while the first antenna is open circuit. In one case, while the second antenna is open circuit, the first antenna substantially detects a marker entering into a surveillance area, the marker oriented substantially perpendicular to an elongated axis with respect to the first antenna. Alternatively, while the first antenna is open circuit, the second antenna substantially detects a marker entering into a surveillance area, the marker oriented substantially parallel to an elongated axis with respect to the second antenna.

The control circuit further comprises a switch to selectively enable operation of the first antenna while the second antenna is open circuit. Likewise, the control circuit further comprises a switch to selectively enable operation of the second antenna while the first antenna is open circuit. An optional ferrite rod can be used for intensifying a magnetic field in each of the first and second antennas.

The system preferably includes a receive circuit and a transmit circuit coupled to each of the first and second antennas for receiving and transmitting signals. Preferably, a single receive circuit and transmit circuit are alternatively coupled to the first and second antennas. The receive circuit receives signals from a surveillance area while the transmit circuit is open circuit. Alternatively, the transmit circuit transmits signals into a surveillance area while the receive circuit is open circuit.

A method of arranging an antenna system for an electronic article surveillance system, in accordance with another inventive arrangement, having a first antenna and a second antenna, the first antenna configured as a loop, the second antenna configured in a "figure-8", comprises the steps of: mounting the first antenna and the second antenna in a substantially overlapping manner; and, field-coupling a control circuit to the first and second antennas for alternatively activating the first and second antennas.

The first and second antennas can each operate as a transmit and receive antenna. Furthermore, the first antenna can transmit and then receive while the second antenna is open circuit. Alternatively, the second antenna can transmit and then receive while the first antenna is open circuit. In all cases, each of the first and second antennas can detect a marker entering into a surveillance area. In one case, while the second antenna is open circuit, the first antenna substantially detects a marker entering into a surveillance area, the marker oriented in a position substantially perpendicular to an elongated axis with respect to the first antenna. Alternatively, while the first antenna is open circuit, the second antenna substantially detects a marker entering into a surveillance area, the marker oriented in a position substantially parallel to an elongated axis with respect to the second antenna.

The control circuit comprises a switch to selectively enable operation of the first antenna while the second antenna is open circuit. Alternatively, the control circuit further comprises a switch to selectively enable operation of the second antenna while the first antenna is open circuit. A ferrite rod can be used for intensifying a magnetic field in each of the first and second antennas.

The method can further include a receive circuit and a transmit circuit coupled to each of the first and second antennas for receiving and transmitting signals. The receive circuit receives signals from a surveillance area while the transmit circuit is open circuit. Alternatively, the transmit circuit transmits signals into a surveillance area while the receive circuit is open circuit.

DETAILED DESCRIPTION OF THE PREFERRED EMBODIMENT

Figure 1:
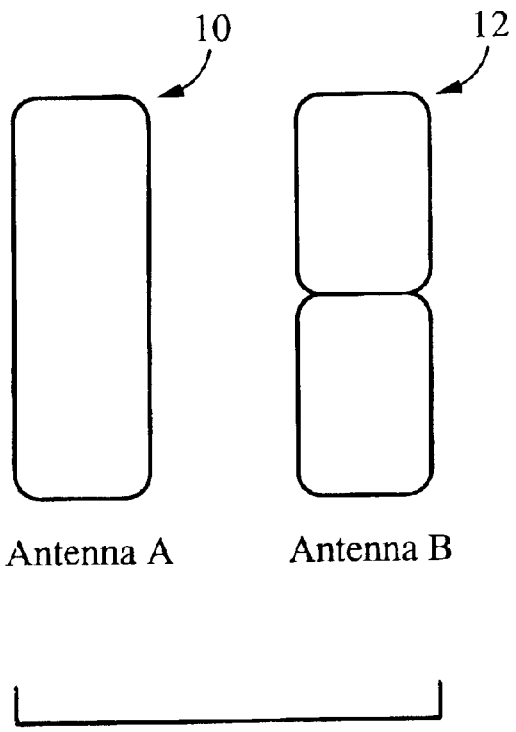
FIG. 1 is a front perspective view of a rectangular loop antenna and "figure 8" antenna positioned separately.

Referring to FIG. 1, in accordance with the preferred embodiment of the invention, two differently shaped antennas are utilized, each capable of transmitting signals into a surveillance area and receiving signals from a surveillance area. Antenna "A" 10 is a rectangular loop antenna and Antenna "B" 12 is a "figure-8" antenna.

Antenna "A" 10 of FIG. 1, the rectangular loop, is a continuous loop of overlapping coils of insulated wire, which may be rectangular or oval. The rectangular or oval has an elongated axis 16. The rectangular loop configuration is also referred to as an in-phase configuration, since the loop is driven by current flowing in same direction. Antenna "B" 12 of FIG. 1, the "figure-8" antenna, is implemented by wrapping insulated wire in a "figure-8" to form two adjacent loops, as shown, and may have rectangular or oval shapes. "Figure-8" configuration is also referred to as an out-of-phase configurations, since the loops are driven by current flowing in opposite directions. Each antenna is formed by repeatedly wrapping an insulated wire to form a coil. Ideally, Antenna A 10 and Antenna B 12 are mounted in substantially the same plane 14. It will be appreciated that the physical properties of coils of wire prevent the two antenna from being precisely in a single plane.

An anti-theft marker or tag, attached to an article of clothing or manufacture, can be positioned in any possible direction when entering a surveillance area in a store doorway or at a checkpoint aisle. In this case, substantial magnetic field coverage of the surveillance area is needed to assure high detection rate of a marker not only in all dimensions but also in all directions.

Figure 2:
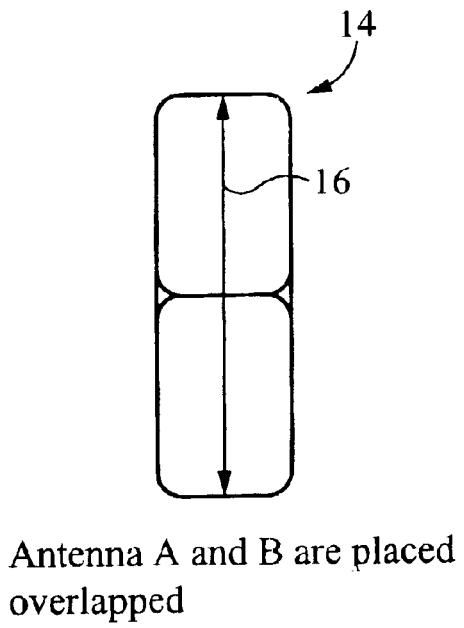
FIG. 2 is a front perspective view of a rectangular loop antenna and "figure 8" antenna configuration interlaced in a substantially overlapping manner.

Referring to FIG. 2, the preferred embodiment of the invention is to mount a rectangular loop antenna (Antenna "A" 10) and a "figure-8" antenna (Antenna "B" 12) in a substantially overlapping manner 14 to assure marker detection in all possible directions. A rectangular loop antenna will provide substantial magnetic field coverage for markers oriented substantially perpendicular to the elongated axis 16. A "figure-8" antenna will provide substantial magnetic field coverage for markers oriented substantially parallel to the elongated axis 16. Therefore, by interlacing the two differently shaped antennas 10 and 12 to compensate each other better to cover all possible marker orientations entering the surveillance area then either antenna configured alone.

A properly chosen control circuit selectively activates one of the two antennas while disabling the other reduces interference between the two antennas 10 and 12; one of the two antenna is open circuit when the other antenna is in operation mode. The control circuit can comprise a switch to selectively enable operation of one antenna while the other antenna is open circuit. Furthermore, a ferrite rod can be coupled to the system for further intensifying magnetic field generated by the system.

Antenna "A" 10 and Antenna "B" 12 each operate as a transmit and receive antenna. That is, Antenna "A" 10 transmits signals and then receives signals while Antenna "B" 12 is open circuit. Likewise, Antenna "B" 12 transmits and receives signals while Antenna "A" 10 is open circuit.

Figure 3:
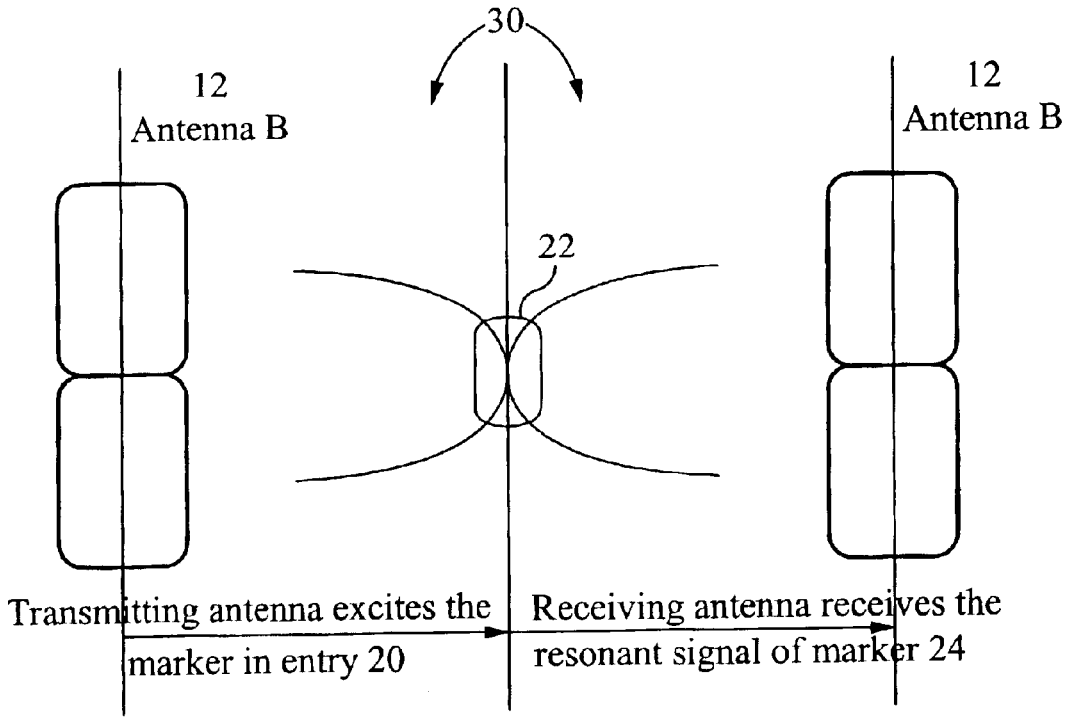
FIG. 3 is a sample illustration of how a "figure-8" antenna transmits and receives signals when a rectangular loop, interlaced to the "figure-8" antenna, is open circuit.

FIG. 3 schematically illustrates how a "figure-8" antenna transmits and receives signals when a rectangular loop, interlaced to the "figure-8" antenna, is open circuit. As previously noted, the "figure 8" antenna (Antenna "B" 12) substantially detects a marker 22 entering into a surveillance area 30 oriented substantially parallel to the elongated axis 16. That is, with a "figure-8" transmitting antenna and "figure-8" receiving antenna, markers vertically entering into the surveillance area are better detected. In the FIG. 3 embodiment, at step 20, with Antenna "A" 10 open circuit, a transmit circuit coupled to Antenna "B" 12 transmits signals into a surveillance area 30 where a marker 22 is located. While the system is transmitting, a receive circuit is open circuit. Once transmission is complete and the marker 22 excites, the transmit circuit coupled to Antenna "B" 12 is open circuit. Following step 20 is step 24, at which a receive circuit coupled to Antenna "B" 12 receives the signals from the marker. The signal is correlative to the shape of the receiving antenna and the marker's position or orientation. Because the orientation of a marker entering the surveillance area cannot be known, preferably the system alternates between using Antenna A 10 and Antenna B 12. In this way, regardless of the orientation of the marker, it will be detected by one of Antenna A 10 or Antenna B 12. The control circuit continuously toggles between the two modes of operation until a marker is detected and alarm is triggered.

An alternative embodiment of the invention would suspend switching or toggling between the two modes of operation once a marker 22 is detected. This alternative system senses the strength of signals received from the marker 22 selectively using both Antenna A 10 and Antenna B 12. If the system determines that one antenna receives a substantially larger signal than the other, the control circuit can suspend toggling between the two antennas and only operate the antenna having the larger received signal. For example, if the marker 22 is oriented perpendicular to the elongated axis and Antenna "A" 10 (the rectangular loop antenna) is open circuit, Antenna "B" 12 (the "figure-8") antenna may not substantially detect the marker 22. Almost instantly, the control circuit would switch to Antenna "A" 10 with Antenna "B" 12 now open circuited, resulting in substantial detection of the marker 22 in the perpendicular orientation. Unlike the preferred embodiment of the invention, this alternative embodiment prevents Antenna "A" 10 from being switched to open circuit, since maintaining the system with Antenna "A" 10 transmitting and receiving effectively detects a marker with a perpendicular orientation.

Figure 4:
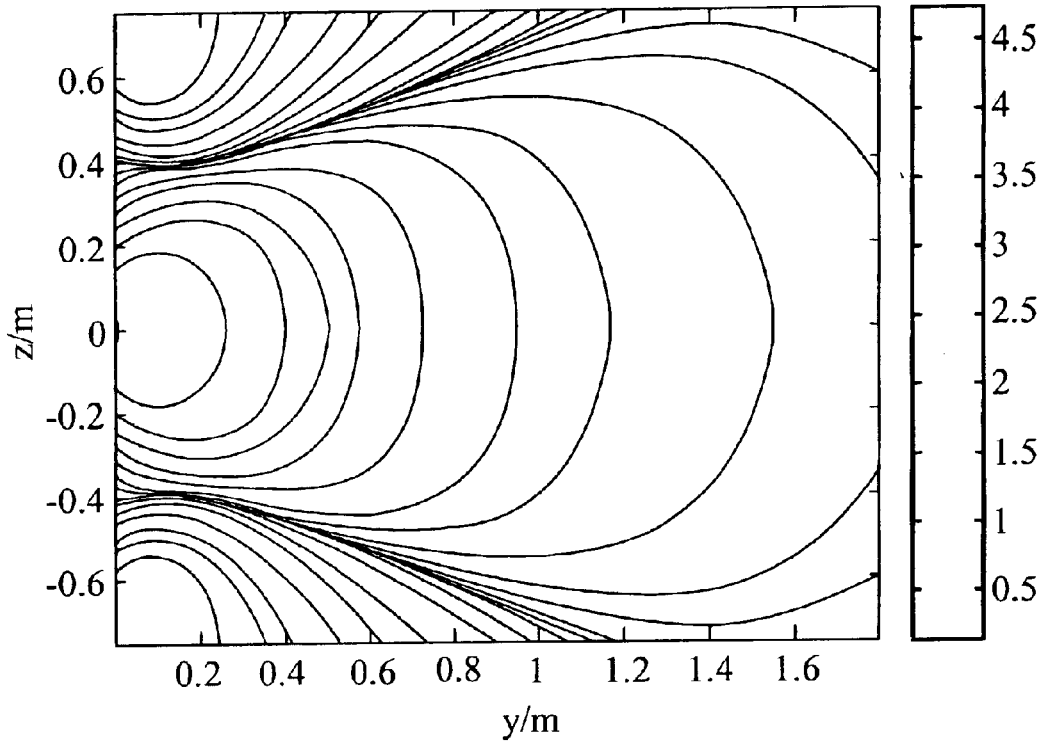
FIG. 4 is a plot showing substantial vertical magnetic field coverage of a "figure-8" antenna.

FIG. 4 is a plot of vertical magnetic field coverage of Antenna "B" 12 ("figure-8" antenna) when Antenna "B" 12 is switched to operation mode and Antenna "A" 10 is open circuit. As shown in the FIG. 4, Antenna "B" 12 covers the surveillance area 30 substantially and excites markers 22 oriented substantially parallel to the elongated axis 16 upon entry into the surveillance area 30.

Figure 5:
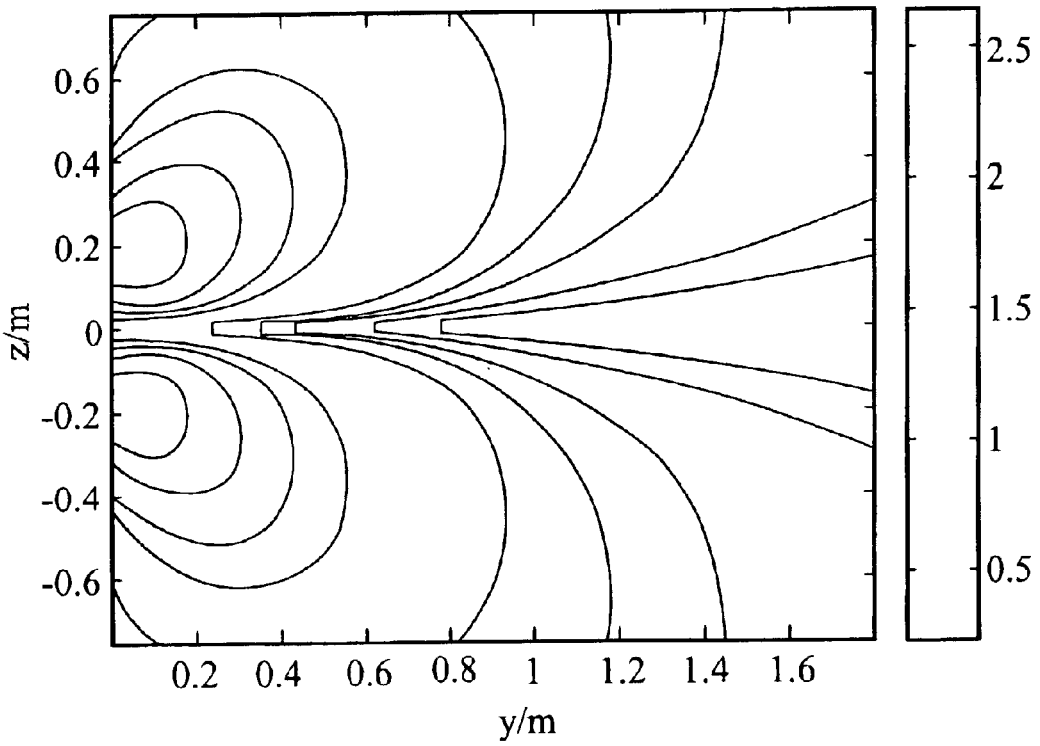
FIG. 5 is a plot showing substantial horizontal magnetic field coverage of a rectangular loop antenna.

FIG. 5 is a plot of horizontal magnetic field coverage of Antenna "A" 10 (rectangular loop antenna) when Antenna "A" 10 is switched to operation mode and Antenna "B" 12 is open circuit. As shown in the FIG. 5, Antenna "A" 10 covers the surveillance area 30 substantially and excites markers 22 oriented substantially perpendicular to the elongated axis 16 upon entry into the surveillance area 30.

This invention has been described in terms of specific embodiment in incorporating details to facilitate the understanding of the principles of construction and operation of the invention. Such reference herein to specific embodiment and the details thereof is not intended to limit the scope of the claims and hereto. It will be apparent to those of ordinary skill in the art that modifications can be made in the embodiment chosen for illustration without departing from the spirit and scope of the invention. Specifically, it will be apparent to one of ordinary skill in the art device of the present invention could be implemented in several different ways and the apparatus disclosed above is only illustrative of the before embodiment invention and is in no way limitation.

What is claimed is:

1. An antenna system for an electronic article surveillance system, comprising:

a first antenna and a second antenna, the first antenna and the second antenna mounted for use in an substantially overlapping manner, the first antenna configured as a loop, the second antenna configured in a "figure-8"; and, a control circuit for alternatively activating the first and second antennas.

2. The system of claim 1, wherein each of the first and second antennas operate as a transmit and receive antenna.

3. The system of claim 1, wherein the control circuit further comprises a switch to selectively enable operation of the first antenna while the second antenna is open circuit.

4. The system of claim 1, wherein the control circuit further comprises a switch to selectively enable operation of the second antenna while the first antenna is open circuit.

5. The system of claim 1, further comprising a ferrite rod for intensifying a magnetic field in each of the first and second antennas.

6. The system of claim 1, wherein the first antenna transmits and then receives while the second antenna is open circuit.

7. The system of claim 1, wherein the second antenna transmits and then receives while the first antenna is open circuit.

8. The system of claim 1, wherein the first antenna substantially detects a marker entering into a surveillance area, the marker oriented substantially perpendicular to an elongated axis with respect to the first antenna while the second antenna is open circuit.

9. The system of claim 1, wherein the second antenna substantially detects a marker entering into a surveillance area, the marker oriented substantially parallel to an elongated axis with respect to the second antenna while the first antenna is open circuit.

10. The system of claim 1, wherein the first antenna and second antenna substantially lie in a common plane.

11. The system of claim 1, wherein a receive circuit is coupled to one of the first and second antennas for receiving signals from a surveillance area.

12. The system of claim 11, wherein the receive circuit is receiving signals from the surveillance area while a transmit circuit is open circuit.

13. The system of claim 1, wherein a transmit circuit is coupled to one of the first and second antenna for transmitting signals into a surveillance area.

14. The system of claim 13, wherein the transmit circuit is transmitting signals into the surveillance area while a receive circuit is open circuit.

15. A method of arranging an antenna system for an electronic article surveillance system, having a first antenna and a second antenna, the first antenna configured as a loop, the second antenna configured in a "figure-8", the method comprising the steps of:

mounting the first antenna and the second antenna in a substantially overlapping manner; and, field-coupling a control circuit to the first and second antennas for alternatively activating the first and second antennas.

16. The method of claim 15, wherein each of the first and second antennas operate as a transmit and receive antenna.

17. The method of claim 15, wherein the control circuit further comprises a switch to selectively enable operation of the first antenna while the second antenna is open circuit.

18. The method of claim 15, wherein the control circuit further comprises a switch to selectively enable operation of the second antenna while the first antenna is open circuit.

19. The method of claim 15, further comprising a ferrite rod for intensifying a magnetic field in each of the first and second antennas.

20. The method of claim 15, wherein the first antenna transmits and then receives while the second antenna is open circuit.

21. The method of claim 15, wherein the second antenna transmits and receives while the first antenna is open circuit.

22. The method of claim 15, wherein the first antenna substantially detects a marker entering into a surveillance area, the marker oriented substantially perpendicular to an elongated axis with respect to the first antenna while the second antenna is open circuit.

23. The method of claim 15, wherein the second antenna substantially detects a marker entering into a surveillance area, the marker oriented substantially parallel to an elongated axis with respect to the second antenna while the first antenna is open circuit.

24. The method of claim 15, wherein the first antenna and second antenna substantially lie in a common plane.

25. The method of claim 15, wherein a receive circuit is coupled to one of the first and second antennas for receiving signals from a surveillance area.

26. The method of claim 25, wherein the receive circuit is receiving signals from the surveillance area while a transmit circuit is open circuit.

27. The method of claim 15, wherein a transmit circuit is coupled to one of the first and second antennas for transmitting signals into a surveillance area.

28. The method of claim 27, wherein the transmit circuit is transmitting signals into the surveillance area while a receive circuit is open circuit.

29. A method of detecting a marker in a surveillance area for an electronic article surveillance system, having a first antenna and a second antenna, the first antenna configured as a loop, the second antenna configured in a "figure-8" manner of operation, the first antenna and the second antenna mounted for use in an overlap manner; a control circuit for alternatively activating the first and second antennas, the method comprising the steps of:

switching the system to a first mode of operation for enabling the first antenna to transmit and receive signals while the second antenna is open circuit; and, switching the system to a second mode of operation for enabling the second antenna to transmit and receive signals while the first antenna is open circuit.

30. The method of claim 29, wherein each of the first and second antennas operate as a transmit and receive antenna.

31. The method of claim 29, wherein the control circuit further comprises a switch to selectively enable operation of the first antenna while the second antenna is open circuit.

32. The method of claim 29, wherein the control circuit further comprises a switch to selectively enable operation of the second antenna while the first antenna is open circuit.

33. The method of claim 29, wherein the first antenna substantially detects a marker entering into a surveillance area, the marker oriented substantially perpendicular to an elongated axis with respect to the first antenna while the second antenna is open circuit.

34. The method of claim 29, wherein the second antenna substantially detects a marker entering into a surveillance area, the marker oriented substantially parallel to an elongated axis with respect to the second antenna while the first antenna is open circuit.

35. The method of claim 29, wherein the first antenna and second antenna substantially lie in a common plane.

36. The method of claim 29, wherein a receive circuit is coupled to one of the first and second antennas for receiving signals from a surveillance area.

37. The method of claim 36, wherein the receive circuit is receiving signals from the surveillance area while a transmit circuit is open circuit.

38. The method of claim 29, wherein a transmit circuit is coupled to one of the first and second antennas for transmitting signals into a surveillance area.

39. The method of claim 38, wherein the transmit circuit is transmitting signals into the surveillance area while a receive circuit is open circuit.

40. An antenna system for an electronic article surveillance system, comprising:

a first antenna and a second antenna, the first antenna and the second antenna mounted for use in an substantially overlapping manner, the first antenna configured as a loop, the second antenna configured in a "figure-8"; and, a control circuit for actively maintaining the system in one mode of operation while a second mode of operation is open circuit.

41. The system of claim 40, wherein the control circuit actively maintains operation of the first antenna when the first antenna detects a substantially larger signal than the second antenna.

42. The system of claim 40, wherein the control circuit actively maintain operation of the second antenna when the second antenna detects a substantially larger signal than the first antenna.

43. A method of detecting a marker in a surveillance area for an electronic article surveillance system, having a first antenna and a second antenna, the first antenna configured as a loop, the second antenna configured in a "figure-8" manner of operation, the first antenna and the second antenna mounted for use in an overlap manner; a control circuit for alternatively activating the first and second antennas, the method comprising the steps of:

switching and actively maintaining the system in a first mode of operation for enabling the first antenna to transmit and receive signals while the second antenna is open circuit; and, switching and actively maintaining the system in a second mode of operation for enabling the second antenna to transmit and receive signals while the first antenna is open circuit.

44. The method of claim 43, wherein the control circuit actively maintains the system in a first mode of operation whenever the first antenna detects a substantially larger signal than the second antenna.

45. The method of claim 43, wherein the control circuit actively maintains the system in a second mode of operation whenever the second antenna detects a substantially larger signal than the first antenna.

* * * * *